US005492097A

United States Patent [19]

Byram et al.

[11] Patent Number: 5,492,097

[45] Date of Patent: Feb. 20, 1996

[54] THROTTLE BODY DEFAULT ACTUATION

[75] Inventors: Robert J. Byram, Grand Blanc; Brent A. Hall, Burton, both of Mich.; Karl J. Haltiner, Jr., Fairport, N.Y.

[73] Assignee: General Motors Corporation, Detroit, Mich.

[21] Appl. No.: 316,418

[22] Filed: Sep. 30, 1994

[51] Int. Cl.[6] ..... F02D 11/10; F02D 41/22

[52] U.S. Cl. ..... 123/396; 123/399; 251/129.01

[58] Field of Search ..... 123/396, 397, 123/398, 399; 251/129.01

[56] References Cited

U.S. PATENT DOCUMENTS

| | | | |
|---|---|---|---|
| 4,867,122 | 9/1989 | Kono et al. | 123/396 |
| 5,018,496 | 5/1991 | Buchl | 123/399 |
| 5,265,572 | 11/1993 | Kadomukai et al. | 123/396 |
| 5,297,521 | 3/1994 | Sasaki et al. | 123/396 |
| 5,301,646 | 4/1994 | Doi et al. | 123/399 |
| 5,429,090 | 7/1995 | Kotchi et al. | 123/396 |

*Primary Examiner*—David A. Okonsky
*Attorney, Agent, or Firm*—Karl F. Barr, Jr.

[57] ABSTRACT

An electronically actuated, air control valve regulates the flow of combustion air to an internal combustion engine. The valve includes an air passage having a throttle valve rotatable therein between a first, minimum air flow position and a second, maximum air flow position. Between the minimum and the maximum air flow positions is a default air flow position for operation of the engine during actuator inoperativeness. A biasing member has a first end operable to impart a force on the valve member in the direction of the default air flow position when the valve member in operable between the minimum air flow position and the default position. Likewise, the biasing member has a second end operable to impart a force on the valve member in the direction of the default air flow position when the valve member is operated in the range between the default air flow position and the maximum air flow position. As a result, a single biasing member operates to position the throttle valve at a default air flow position between the minimum and the maximum air flow positions across the entire range of positions.

4 Claims, 5 Drawing Sheets

THROTTLE BODY DEFAULT ACTUATION

TECHNICAL FIELD

The invention relates to throttle body mechanisms for internal combustion engines and, particularly, to an apparatus for positioning the throttle valve of an electronically actuated throttle body in a default position allowing positive air flow therethrough.

BACKGROUND

Electronically controlled throttle valves are contemplated for controlling the quantity of combustion air admitted to the intake manifold of internal combustion engines. These systems, typically referred to in the automotive arts as electronic throttle control systems (ETC), utilize an operator-actuated pedal position sensor which functions to transmit driver intent to an electronic actuator for positioning the throttle valve. It may be desirable to mechanically locate the throttle valve in a predetermined "default" position at times of actuator inoperativeness thereby assuring continued engine operation.

A contemplated apparatus for default positioning of the throttle valve utilizes a throttle valve having a range of travel extending from a negative throttle plate position through a zero or minimum throttle plate position at which air flow through the throttle valve is minimized to a maximum or wide-open-throttle position in which air flow is maximized. During operation of the electronic actuator, the throttle plate is operated between the minimum and maximum air flow positions. Inoperativeness of the actuator allows a biasing member to move the throttle plate to the negative throttle plate position assuring a default quantity of air flow to the engine and, therefore, continued engine operation. The negative position throttle body, referred to as an over-center design, involves costly manufacturing processes imposed by throttle bore/valve plate tolerances required to allow the throttle plate deflection through the zero or minimum air flow position.

SUMMARY OF THE PRESENT INVENTION

The present invention discloses an air control valve or throttle body having a valve which is operated by an electronic throttle actuator between a minimum air flow position and a maximum air flow position. During inoperativeness of the actuator, a default mechanism positions the throttle valve in a default position between the minimum and the maximum positions. In the default position, positive air flow through the valve allows continued engine operation.

The air control valve includes a housing having an intake air passage or throttle bore in which is disposed a throttle valve. The throttle valve is rotatable between a minimum and a maximum position to thereby meter the quantity of air passing through the throttle bore and to the engine. The throttle valve, preferably of the butterfly type, includes a throttle plate attached to a rotatable shaft which extends diametrically across the throttle bore.

The throttle shaft to which the throttle plate is attached, is driven by the electronic actuator to a desired location between the minimum and the maximum air flow positions. As mentioned above, a default position is located between the minimum and the maximum valve positions. It is desirable that in all cases of actuator inoperativeness the throttle valve be positioned in the default position to assure continued engine operation at the default air flow. A biasing member is operable on the throttle shaft at locations between the minimum air flow position and the default position and at locations between the default position and the maximum air flow position to return the throttle valve to the default position.

The biasing member includes a spirally wound torsion spring in a coaxial relationship to the throttle valve shaft. The spring ends are preloaded such that each end exerts an opposed, rotational force on the throttle valve shaft. A spring stop on the housing limits the travel of each end of the torsion spring such that the rotational forces exerted by the two ends of the spring member on the throttle valve shaft are only applied to the shaft in the direction of the default throttle valve position. As such, during positioning of the throttle valve by the actuator, at throttle valve locations between the minimum air flow position and the default air flow position, one end of the spring member exerts a force on the throttle valve in the direction of the default position while the second end of the spring member is grounded against a housing stop. Should the actuator become inoperative in this range of motion, the first end of the spring member will return the valve to the default position. Alternatively, at throttle valve locations between the default air flow position and the maximum air flow position, the second end of the spring member exerts a force on the throttle valve in the direction of the default position while the first end of the spring member is grounded against a housing stop. Should the actuator become inoperative in this range of motion, the second end of the spring member will operate to return the throttle valve to the default position.

As a result of the bias exerted by the first and second spring ends against the throttle valve shaft, the throttle valve is biased towards a default position from all locations within it operating range. The bias of the throttle valve towards the default air flow position is achieved with a single spring member.

Other objects and features of the invention will become apparent by reference to the following description and to the drawings.

DESCRIPTION OF THE PREFERRED EMBODIMENTS

Figure 1:
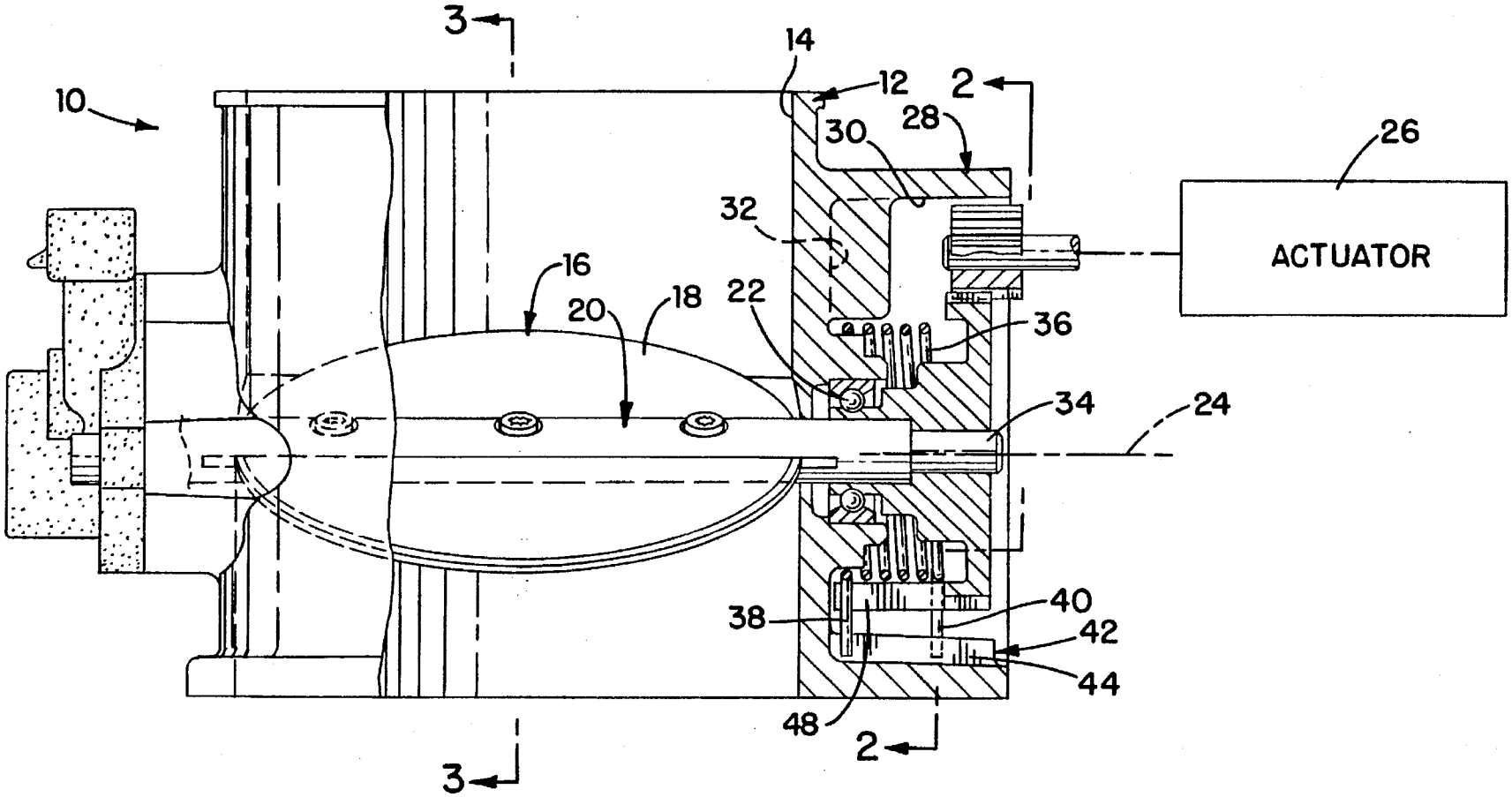
FIG. 1 is a partial sectional view of an air control valve assembly for an internal combustion engine embodying features of the present invention.
Figure 3:
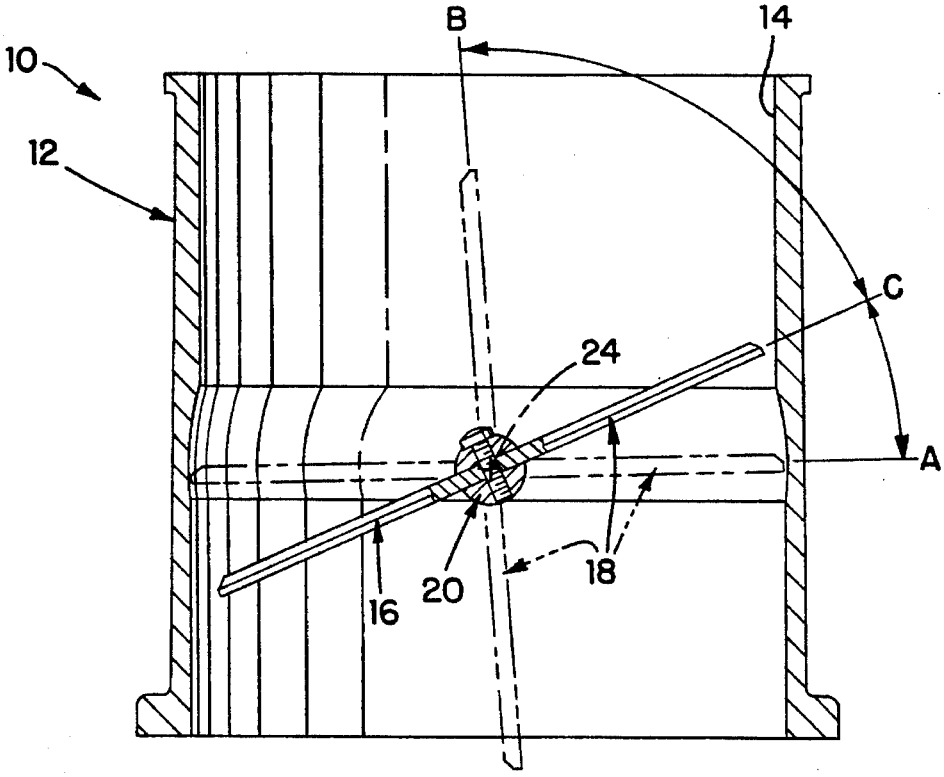
FIG. 3 is a schematic view of a throttle valve, of the air control valve of FIG. 1, illustrating the range of motion of the valve.
Figure 4:
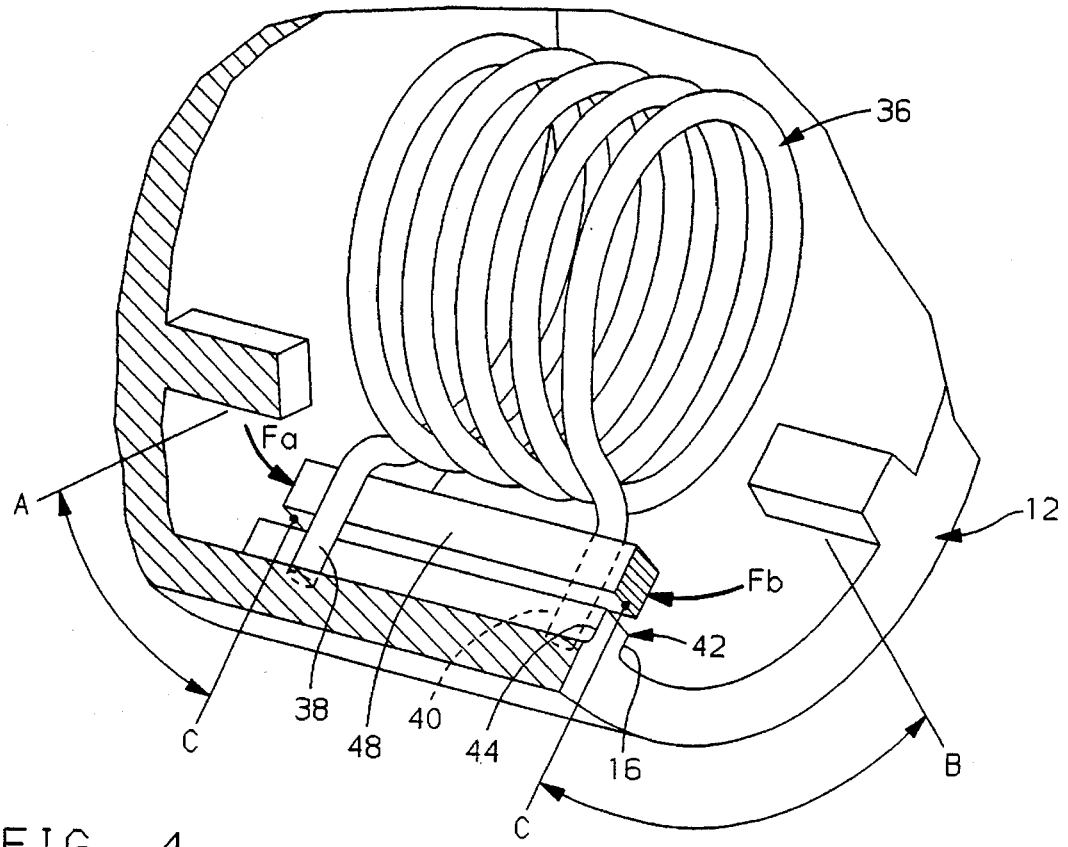
FIGS. 4, 5 and 6 are schematic illustrations of the operation of a first embodiment of the present invention as it is embodied in the air control valve assembly of FIG. 1.
Figure 5:
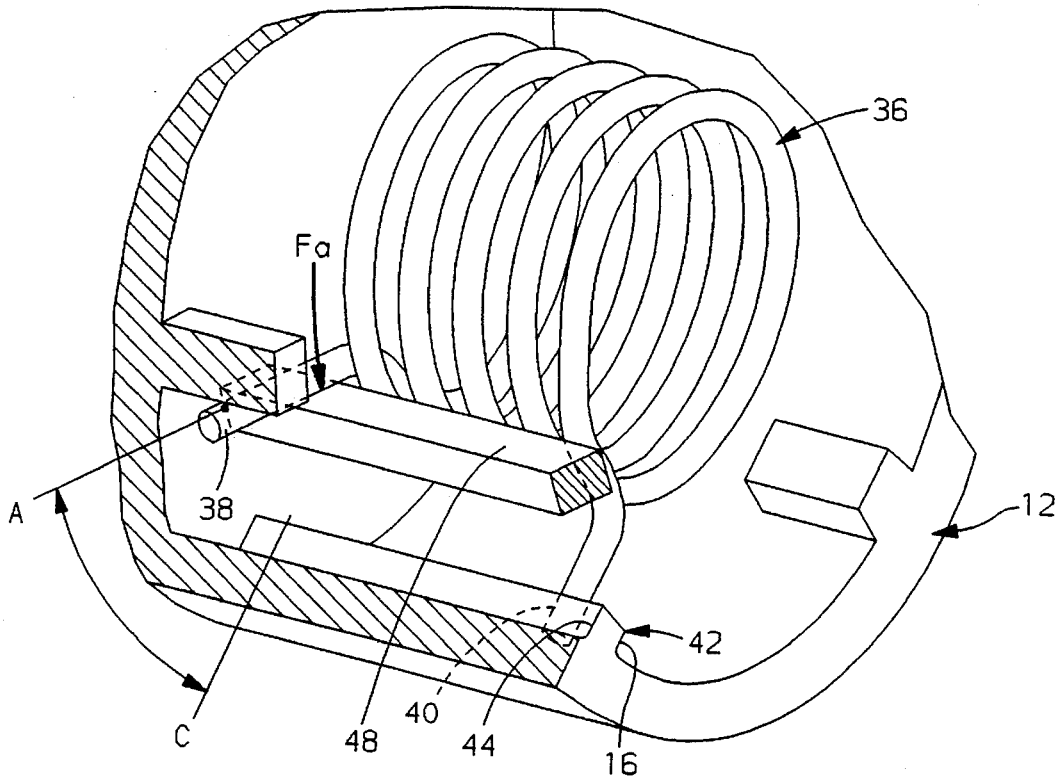

Referring to FIG. 1, an air control valve assembly, designated generally as 10, is shown having a throttle body housing 12 with an air flow passage or throttle bore 14 extending therethrough. The throttle bore 14 conducts air to the intake system of an internal combustion engine (not shown). A throttle valve 16, which includes a throttle plate 18 attached to a shaft 20, is rotatably mounted within the throttle bore 14 of the throttle body housing 12. Bearings 22 support the throttle valve shaft 20 in the housing 12 and define a throttle valve axis 24 about which the valve 16 rotates to meter the flow of air through the throttle bore 14. FIG. 3 illustrates the full range of motion of the throttle valve 16 in the bore 14. The valve is rotatably moveable from a minimum air flow position "A" to a maximum air flow position "B". Intermediate of the minimum and maximum throttle valve positions is a default position "C". The default position "C" relates to a predetermined positive air flow which will allow continued engine operation should the actuating mechanism used to position the throttle valve become inoperative.

Operably connected to the throttle shaft 20 is an electronic actuator 26. The actuator drives the throttle valve 16, based on operator input, to position the throttle valve between the minimum "A" and the maximum "B" air flow positions.

Referring now to FIGS. 1, 2, 4 and 5, the throttle body housing 12 includes a throttle return spring housing portion 28 which includes an inner wall 30 and a bottom 32 through which the end 34 of the throttle valve shaft 20 extends for attachment to the actuator 26. A biasing member such as spirally wound torsion spring 36 is disposed within the spring housing portion 28 of the throttle body housing 12. The spring 36 surrounds the end 34 of the throttle valve shaft 20 in a coaxial relationship therewith and includes first and second ends 38 and 40, respectively. Support for the spring coils may be provided by a bushing disposed between the throttle shaft 20 and the coils.

Figure 6:
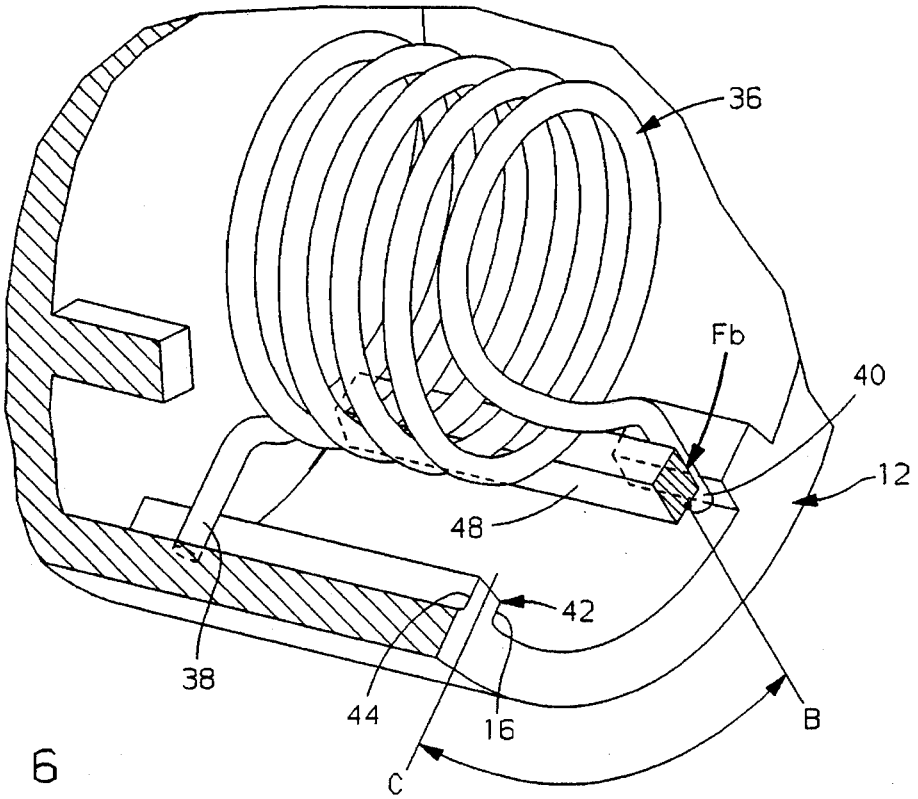

The spring member 36 is rotationally preloaded within the spring housing 28 by rotating the spring ends 38,40 in opposite directions about the throttle valve axis 24 in the direction of the spring bias. The preload of spring 36 is maintained by allowing each spring end 38,40 to abut a stop 42 in the spring housing portion 28. In the embodiment shown in FIGS. 4, 5 and 6, the spring ends 38,40 abut opposite sides 44,46 of the housing stop 42 resulting in a spring force Fa being exerted on side 44 of the housing stop 42 in the counterclockwise direction, as viewed in the Figures, of rotation about axis 24, and a spring force Fb being exerted on side 46 of the housing stop 42 in the clockwise direction of rotation about axis 24.

A spring actuating tang 48 depends from the throttle shaft 20 of the throttle valve 16 and is configured for positioning between the spring ends 38,40 in their positions against the housing stop 42; the position referred to as the default throttle position "C". In the default position, the throttle valve plate 18 is positioned within the throttle bore 14 to allow a positive, default quantity of air to flow to the intake of the engine allowing continued engine operation with no throttle plate movement as in the case of actuator inoperativeness. In the default position "C", a neutral or zero force condition exists on the throttle valve spring actuating tang 48 with the spring ends 38,40 seated against opposing sides 44,46 of the housing stop 42 and the tang 48 positioned therebetween.

Figure 2:
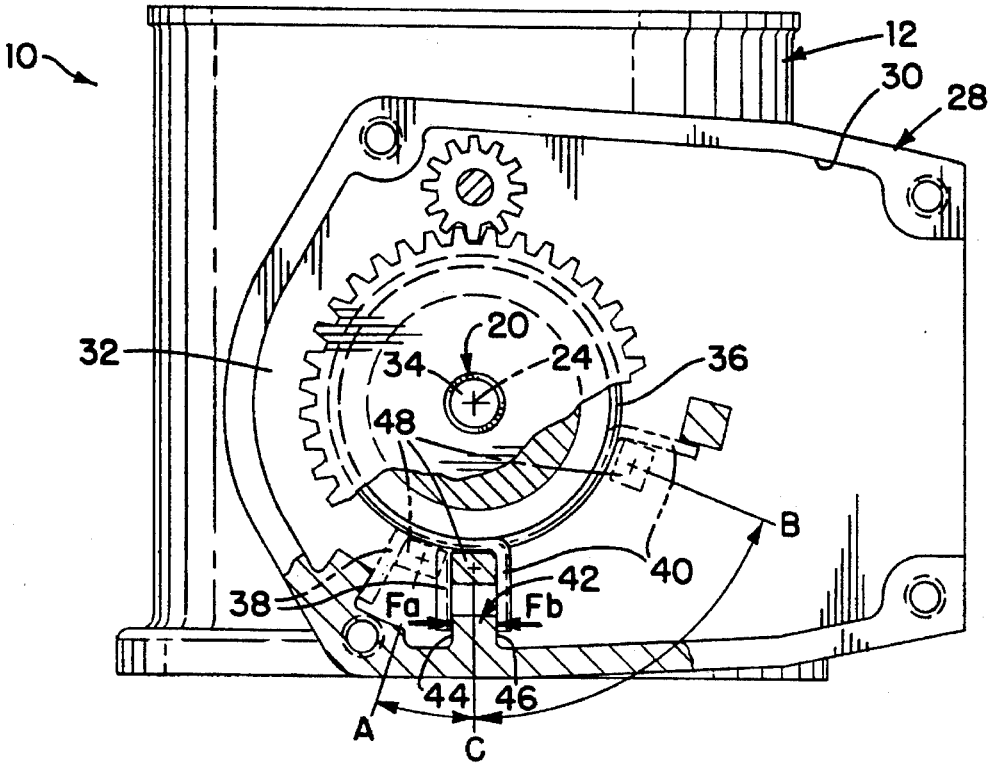
FIG. 2 is a side view of the air control valve assembly, partially in section, of FIG. 1.

During actuator operation and positioning of the throttle valve 16, the actuator 26 will rotate the throttle valve shaft 20 and attached throttle valve plate 18 through a range of motion extending between the minimum air flow position "A" and the maximum air flow position "B"; the range of motion including the default position "C". In the range of motion between the minimum air flow position "A" and the default air flow position "C", shown in FIG. 5, the first spring end 38 is moved off of its seated position against the housing stop 42. In this range of motion, force Fa is exerted on the spring actuating tang 48 and acts to return the tang to the default position "C". Actuator inoperativeness in the range of motion between the minimum air flow position "A" and the default position "C" will result in the throttle valve tang 48, and associated throttle valve 16, being moved to the default position "C" under the force Fa exerted by the spring end in the counterclockwise direction. Once the tang 48 of the throttle shaft 20 is returned to the default position "C", it is prevented from moving off of the default position "C" by the action of both spring ends 38,40 against the housing stop 42 and the forces Fa and Fb exerted thereon in opposing directions which are operable to capture the tang 48 therebetween, as shown in FIG. 2. Similarly, in the range of motion between the default air flow position "C" and the maximum air flow position "B", shown in FIG. 6, the second spring end 40 is moved off of its seated position against the side 46 of the housing stop 42. In this range of motion, force Fb is exerted on the valve shaft tang 48 and acts to return the tang to the default position "C". Actuator inoperativeness in the range of motion between the default air flow position "C" and the maximum air flow position "B" will result in the throttle valve 16 being moved to the default position "C" under the force Fb exerted by the spring end 40 in the clockwise direction. Similarly, once the tang 48 of the throttle shaft 20 is returned to the default position "C", it is prevented from moving off of the default position "C" by the action of both spring ends 38,40 against the housing stop 42 and the forces Fa and Fb exerted thereon in opposing directions which are operable to capture the tang 48 therebetween.

Figure 7:
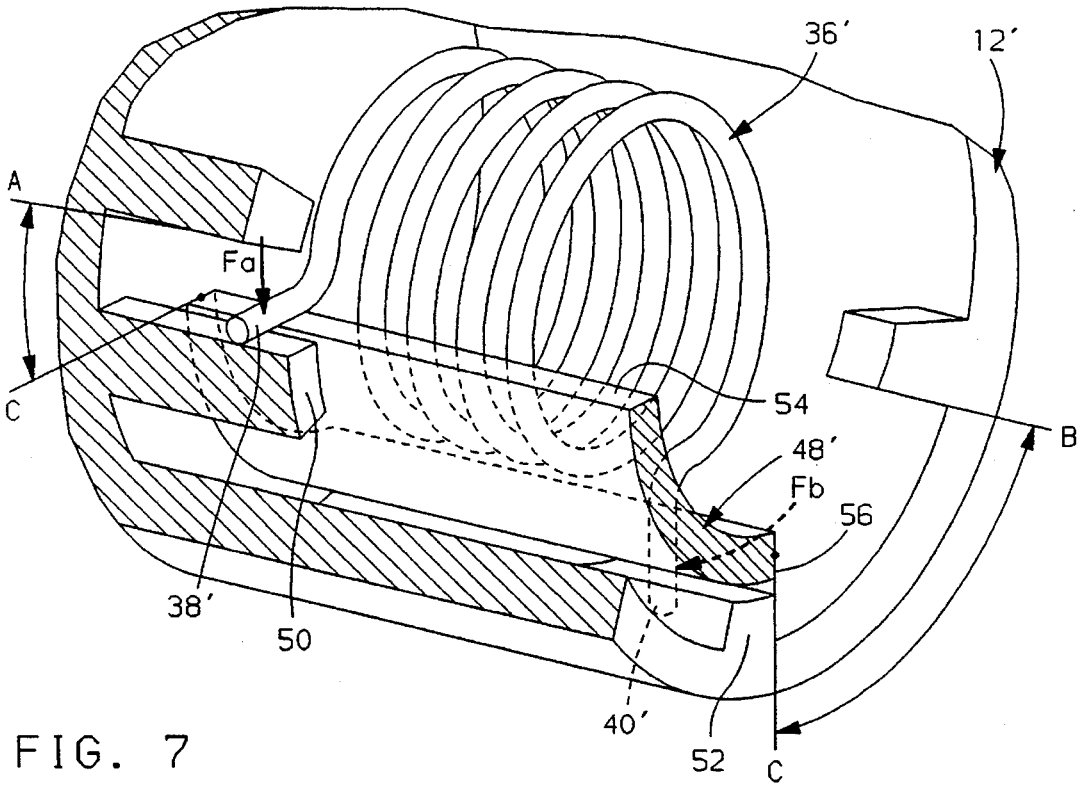
FIGS. 7, 8 and 9 are schematic illustrations of the operation of a second embodiment of the present invention as it is embodied in the air control valve assembly of FIG. 1.
Figure 8:
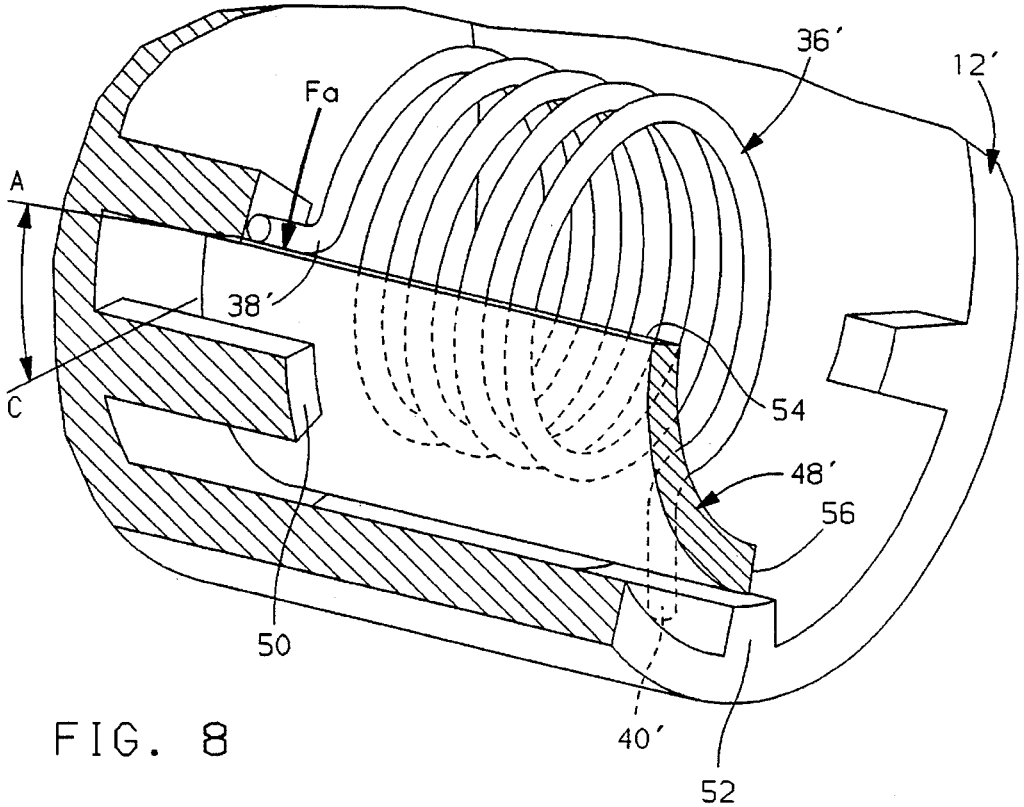
Figure 9:
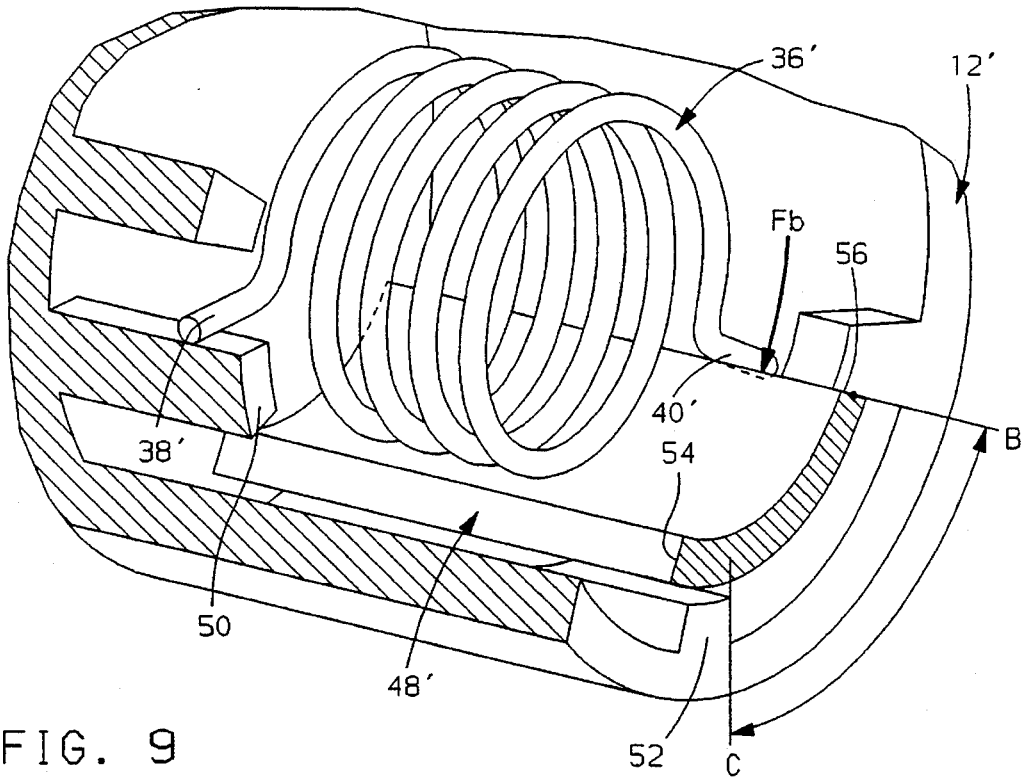

It is not essential to the operation of the present invention that the first and second ends of the spring member be positioned against a common housing stop as in the above example. An alternate embodiment of the invention, shown in FIGS. 7, 8 and 9, utilizes a throttle body housing 12' having first and second housing stops 50,52 located in arcuately separated positions about the throttle valve shaft axis. In the preloaded state, the ends 38',40' of the spring member 36' separately engage the housing stops 50,52, respectively. The first spring end 38' engages first housing stop 50 and exerts a force Fa in the counterclockwise direction, as viewed in the Figures, while the second spring end 40' engages second housing stop 52 and exerts a force Fb in the clockwise direction. In this embodiment of the invention the default position of the throttle valve is defined across an arc between the stops 50,52 and the spring actuation tang 48' depending from the throttle valve shaft will similarly include the arc between its actuating faces 54,56. Although tang 48' is illustrated as a one piece body in the Figures, it is contemplated that multiple tangs having faces 54,56 rotating in a fixed relationship to each other are equally suitable to the present application.

During actuator operation and positioning of the throttle valve, the actuator will rotate the throttle valve through a range of motion extending between the minimum air flow position "A" and the maximum air flow position "B"; the range of motion including the default position "C". In the range of motion between the minimum air flow position "A" and the default air flow position "C", shown in FIG. 8, the first spring end 38' is moved off of its seated position against the housing stop 50. In this range of motion, force Fa is exerted on the spring actuating tang 48' and acts to return the tang to the default position "C". Actuator inoperativeness in the range of motion between the minimum air flow position "A" and the default position "C" will result in the throttle valve tang 48', and associated throttle valve, being moved to the default position "C" under the force Fa exerted by the spring end in the counterclockwise direction. Once the tang 48' is returned to the default position "C", it is prevented from moving off of the default position "C" by the action of both spring ends 38',40' against the housing stops 50,52 and the forces Fa and Fb exerted thereon in opposing directions which are operable to capture the tang 48' therebetween. Similarly, in the range of motion between the default air flow position "C" and the maximum air flow position "B", shown in FIG. 9, the second spring end 40' is moved off of its seated position against the housing stop 52. In this range of motion, force Fb is exerted on the valve shaft tang 48' and acts to return the tang to the default position "C". Actuator inoperativeness in the range of motion between the default air flow position "C" and the maximum air flow position "B" will result in the throttle valve tang 48' being moved to the default position "C" under the force Fb exerted by the spring end 40' in the clockwise direction. Similarly, once the tang 48' of the throttle shaft is returned to the default position "C", it is prevented from moving off of the default position "C" by the action of both spring ends 38',40' against the housing stops 50,52 and the forces Fa and Fb exerted thereon in opposing directions which are operable to capture the tang 48' therebetween.

The disclosed invention provides an air control valve for an internal combustion engine in which the throttle valve is positioned through an electronic actuator. A default position providing positive air flow to the engine is achieved through the use of a single spring member. The throttle default position lies between the minimum and maximum air flow positions of the throttle valve.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

The embodiments of the invention in which an exclusive property or privilege is claimed are defined as follows:

1. An air control valve for an internal combustion engine comprising a housing having an air intake passage extending therethrough with a throttle valve rotatably mounted in said passage, said throttle valve rotatable about an axis within a range of rotation between a first, minimum air flow position and a second, maximum air flow position, said range including a default position intermediate of said minimum and said maximum air flow positions of said valve, a spring member having a first end operable to impart a force on said valve, in the direction of said default position, when said valve is between said first, minimum air flow position and said default air flow position, and a second end operable to impart a force on said valve, in the direction of said default position, when said valve is between said default air flow position and said maximum air flow position, said first and second ends of said spring member operable to return said valve to said default position through said range of rotation.

2. An air control valve for metering air to an internal combustion engine comprising a housing having an air intake passage extending therethrough with a throttle valve rotatably mounted in said passage, said throttle valve rotatable about an axis within a range between a first, minimum air flow position and a second, maximum air flow position, said range including a default position intermediate of said minimum and said maximum air flow positions of said valve, a spiral-wound torsion spring located coaxially about said throttle valve axis, having a first end operable to impart a force on said valve, in the direction of said default position, when said valve is between said first, minimum air flow position and said default air flow position, and a second end operable to impart a force on said valve, in the direction of said default position, when said valve is between said default air flow position and said maximum air flow position, said first and second ends of said spring member operable to return said valve to said default position through said range.

3. An air control valve for metering air to an internal combustion engine comprising a housing having an air intake passage extending therethrough with a throttle valve rotatably mounted in said passage, said throttle valve rotatable about an axis within a range of rotation between a first, minimum air flow position and a second, maximum air flow position, said range including a default position intermediate of said minimum and said maximum air flow positions of said valve, a spiral-wound torsion spring member located coaxially about said throttle valve axis, having a first end operable to impart a force on said valve, in the direction of said default position, and a second end operable to ground against a stop, fixed relative to said housing, when said valve is between said first, minimum air flow position and said default air flow position, and said second end operable to impart a force on said valve, in the direction of said default position, and said first end operable to ground against said stop, fixed relative to said housing, when said valve is between said default air flow position and said maximum air flow position, said first and second ends of said spring member operable to return said valve to said default position through said range of rotation.

4. An air control valve for metering combustion air to an internal combustion engine comprising a throttle housing having an air passage extending therethrough, a throttle valve mounted for rotation in said air passage to vary the flow of air therethrough, said valve comprising a throttle plate mounted on a shaft rotatable about an axis, said valve positionable within a range between a first, minimum air flow position and a second, maximum air flow position, said range including a default position intermediate of said minimum and said maximum positions, a spirally wound torsion spring disposed in a coaxial relationship to said throttle valve shaft, said spring member having a first end located adjacent a first stop face and imparting a first force thereon in a first direction and a second end located adjacent a second stop face and imparting a second force thereon, opposing said force from said first spring end, said throttle valve shaft having a spring actuator depending therefrom and rotatable therewith, said actuator positioned between said first and said second stop faces to locate said shaft and said throttle valve in said default air flow position, and operable to move said first spring end off of said first stop face, against said first force, as said throttle valve moves between said minimum air flow position and said default air flow position, and operable to move said second spring end off of said second stop face, against said second opposing force, as said throttle valve moves between said default air flow position and said maximum air flow position, said first and said second forces operable to return said throttle spring actuator to said location intermediate of said first and said second stop faces to thereby return said throttle valve to said default air flow position throughout said throttle valve range.

* * * * *